US010696085B2

(12) United States Patent
Feingold

(10) Patent No.: US 10,696,085 B2
(45) Date of Patent: Jun. 30, 2020

(54) FOLDER WITH MAGNETIC CLOSURE ADAPTED FOR USE IN VISUAL MANAGEMENT SYSTEMS

(71) Applicant: Irene B. Feingold, Rochester, NY (US)

(72) Inventor: Irene B. Feingold, Rochester, NY (US)

( * ) Notice: Subject to any disclaimer, the term of this patent is extended or adjusted under 35 U.S.C. 154(b) by 0 days.

(21) Appl. No.: 16/038,784

(22) Filed: Jul. 18, 2018

(65) Prior Publication Data

US 2019/0023056 A1 Jan. 24, 2019

Related U.S. Application Data

(60) Provisional application No. 62/535,013, filed on Jul. 20, 2017.

(51) Int. Cl.

| | |
|---|---|
| ***B42F 13/00*** | (2006.01) |
| ***B42F 7/06*** | (2006.01) |
| ***B42F 7/02*** | (2006.01) |
| ***B42F 7/04*** | (2006.01) |
| *B42F 13/40* | (2006.01) |

(52) U.S. Cl.

CPC ..... *B42F 13/0026* (2013.01); *B42F 7/025* (2013.01); *B42F 7/04* (2013.01); *B42F 7/065* (2013.01); *B42F 13/40* (2013.01); *B42P 2241/02* (2013.01)

(58) Field of Classification Search

CPC ..... B42F 13/0026; B42F 7/025; B42F 7/04; B42F 7/065; B42F 7/02; B42F 21/06; B42P 2241/02; A45C 13/1069; B42D 3/10; B65D 33/24

USPC .... 229/67.4, 67.1, 67.3, 120.09, 125.11, 71; 206/425, 818; 281/31, 22, 29; 383/106; 150/112; 40/359, 661.01

See application file for complete search history.

(56) References Cited

U.S. PATENT DOCUMENTS

| | | | | |
|---|---|---|---|---|
| 3,685,170 A * | 8/1972 | Fairleigh | G09B 1/08 | 434/248 |
| 5,904,373 A * | 5/1999 | Krapf | B42F 7/02 | 281/29 |
| 5,924,624 A * | 7/1999 | Martin | B42D 15/0053 | 229/71 |
| 7,708,141 B1 * | 5/2010 | Huang | A45C 3/02 | 206/425 |
| 2015/0021899 A1 * | 1/2015 | Coore-Widener | G09F 1/10 | 281/29 |
| 2019/0200719 A1 * | 7/2019 | Sullivan | A45C 13/1069 | |

* cited by examiner

*Primary Examiner* — Christopher R Demeree

(74) *Attorney, Agent, or Firm* — Barnes & Thornburg LLP

(57) ABSTRACT

The present disclosure is directed to a folder including a magnetic closure adapted for use in a visual management system. The folder includes a back flap and a front flap that cooperate to define a storage area for papers. The magnetic closure is configured to selectively hold the folder in a closed position.

20 Claims, 4 Drawing Sheets

FOLDER WITH MAGNETIC CLOSURE ADAPTED FOR USE IN VISUAL MANAGEMENT SYSTEMS

PRIORITY CLAIM

This application claims priority under 35 U.S.C. § 119(e) to U.S. Provisional Application Ser. No. 62/535,013, filed Jul. 20, 2017, which is expressly incorporated by reference herein.

BACKGROUND

Folders and other protective sleeves may be used to store papers. Such folders and sleeves can be used in many different settings. Some folders and sleeves incorporate pockets, prongs, clips, latches and the like to secure papers within the folder. These retention mechanisms can make access to the papers in the folder cumbersome.

SUMMARY

A folder according to the present disclosure includes a back flap and a front flap that define a paper storage space therebetween. The front flap is coupled to the back flap along two sides forming a free corner of the front flap. The free corner of the front flap can be lifted away from the back flap to open the front flap and access the paper storage space.

In illustrative embodiments, the folder may include a magnetic closure that provides means for holding the front flap closed and for retaining papers in the paper storage space when the front flap is closed. The magnetic closure includes a patch of magnetic-receptive material coupled to the back flap and a magnet coupled to the front flap. The patch and the magnet are arranged between the back flap and the front flap adjacent to the free corner of the front flap such that papers in the paper storage area are trapped between the patch and the magnet when the front flap is closed.

In illustrative embodiments, the front and back flaps of the folder comprise flexible vinyl materials. The front flap is transparent so that papers retained in the paper storage area are visible even when the front flap is in the closed position. The back flap may be opaque or transparent.

In illustrative embodiments, the folder includes mount strips coupled to a back side of the back flap so that the folder can be vertically suspended on a status board, wall, or the like. The mount strips may be magnetic strips, adhesive strips, hook and loop material strips, or any other suitable connecting member. The mount strips extend along and parallel to the left side edge of the back flap and the right side edge of the back flap in the illustrative embodiment.

Visual management systems according to the present disclosure may include a status board and one or more folders as described in this application. The folders may allow convenient access to papers showing management information and allowing for quick replacement/update of the information.

Methods of using folders as described in the present disclosure are also provided in this application. For example, a method of updating a visual management system including a folder as described is shown and described.

In illustrative embodiments, such a method may include lifting the free corner of the front flap of the folder to disengage a magnetic closure and lowering the free corner of the front flap of the folder to re-engage the magnetic closure. The method may also include inserting a sheet of paper into the folder between the back flap and the front flap and/or marking on the sheet of paper to update information on the sheet of paper.

Additional features of the present disclosure will become apparent to those skilled in the art upon consideration of illustrative embodiments exemplifying the best mode of carrying out the disclosure as presently perceived.

BRIEF DESCRIPTIONS OF THE DRAWINGS

The detailed description particularly refers to the accompanying figures in which.

Figure 9:
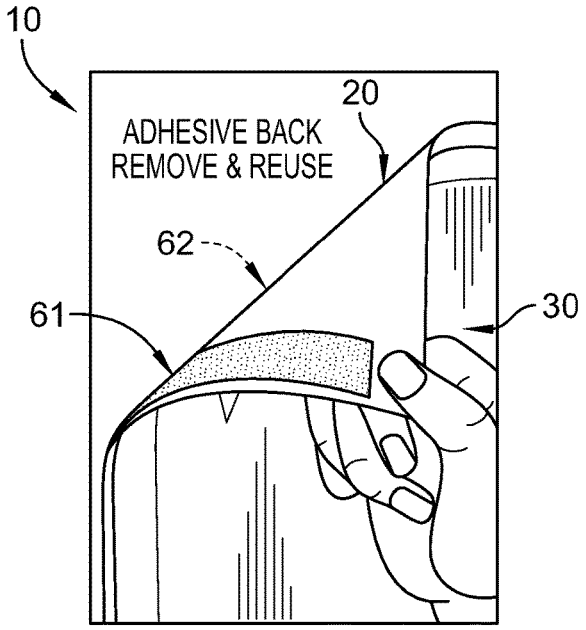
Figure 10:
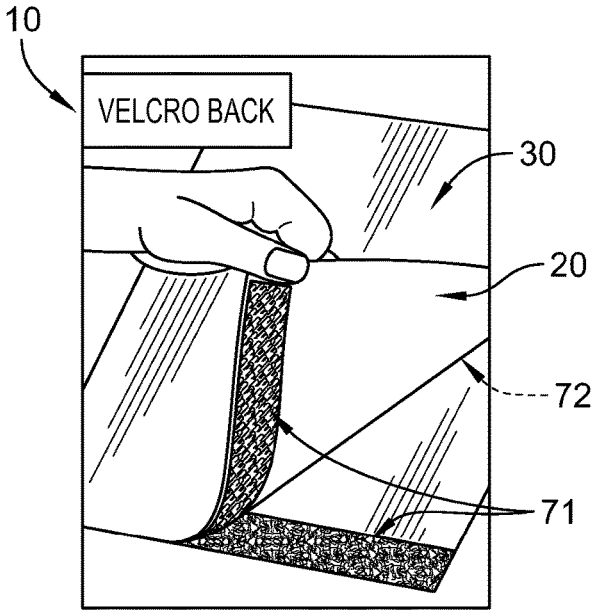

FIG. 9 is a detail view of a back side of a back flap included as part of a folder in accordance with the present disclosure showing that the mount strips may be adhesive strips; and FIG. 10 is a detail view of a back side of a back flap included as part of a folder in accordance with the present disclosure showing that the mount strips may be made up of hook and loop material strips so as to be removable/replaceable on a board.

DETAILED DESCRIPTION

Figure 1:
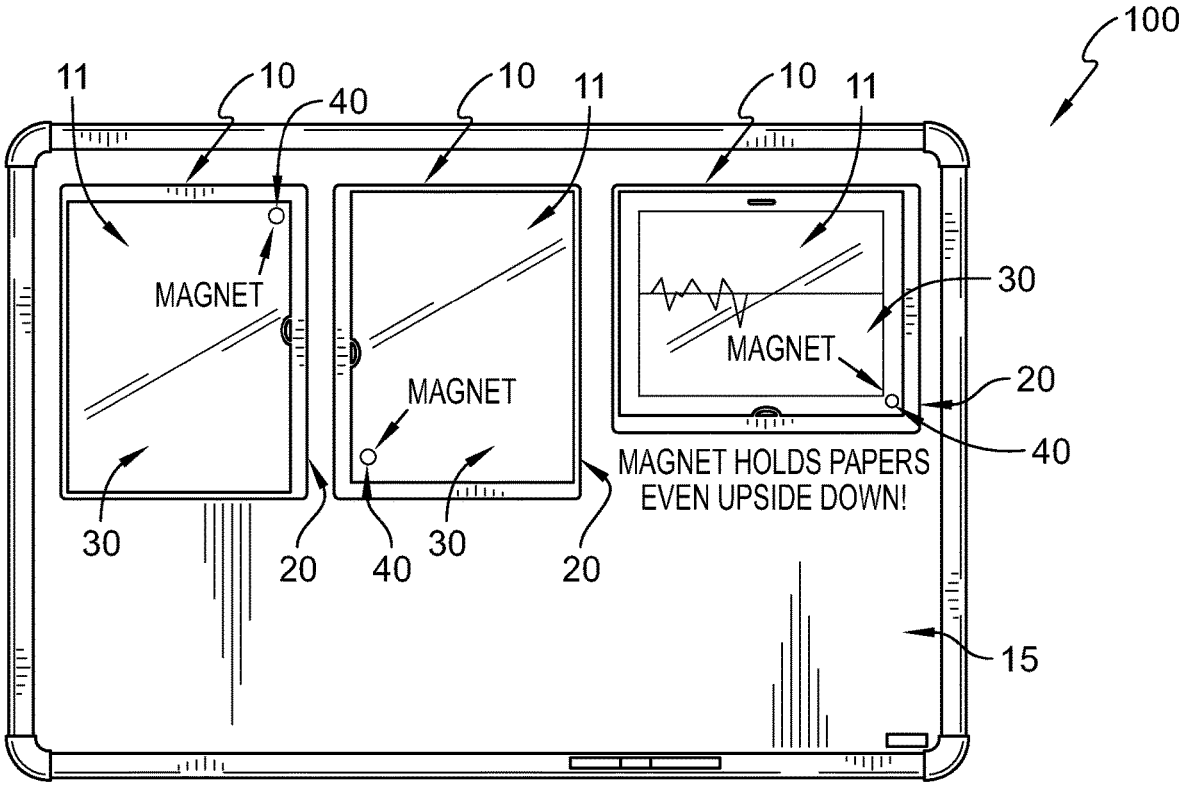
FIG. 1 is a front elevation view of a visual management system including a status board and a number of folders according to the present disclosure each having a magnetic closure adapted to provide means for holding a front flap of the folder closed and for retaining papers in the folder when the front flap is closed.

Folders 10 in accordance with the present disclosure may be mounted to a status board 15 to provide a visual management system 100 as shown in FIG. 1. The folders 10 are illustratively suspended on the status board 15 in a vertical orientation and the folders 10 include transparent front flaps 30 so that papers 11 in the folders 10 are visible to users of the system 100. In the illustrative embodiment, the folders 10 each include a magnetic closure 40 that provides means for holding the front flap 30 of the folder 10 closed and for retaining papers 11 in the folder 10 when the front flap 30 is closed. The magnetic closure 40 is configured to hold the papers 11 in place even when an opening of the folder 10 faces downwardly as suggested in FIG. 1.

Figure 2:
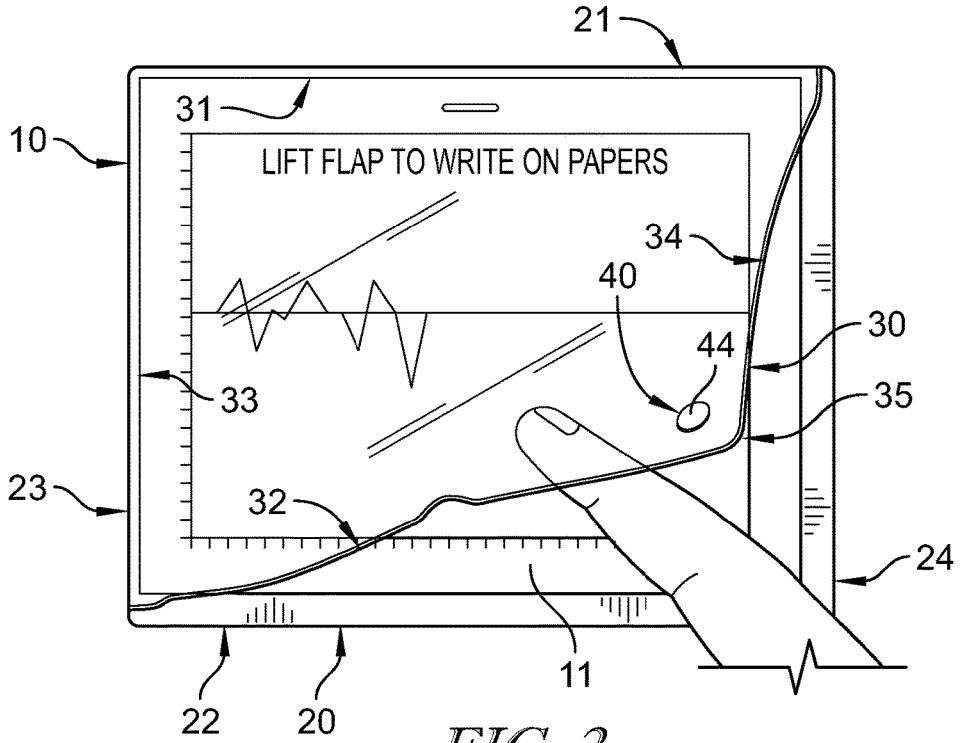
FIG. 2 is a front elevation view of a folder according to the present disclosure showing a free corner of the front flap of the folder lifted and the magnetic closure disengaged so as to open the front flap making papers in the folder accessible for update and/or replacement.
Figure 3:
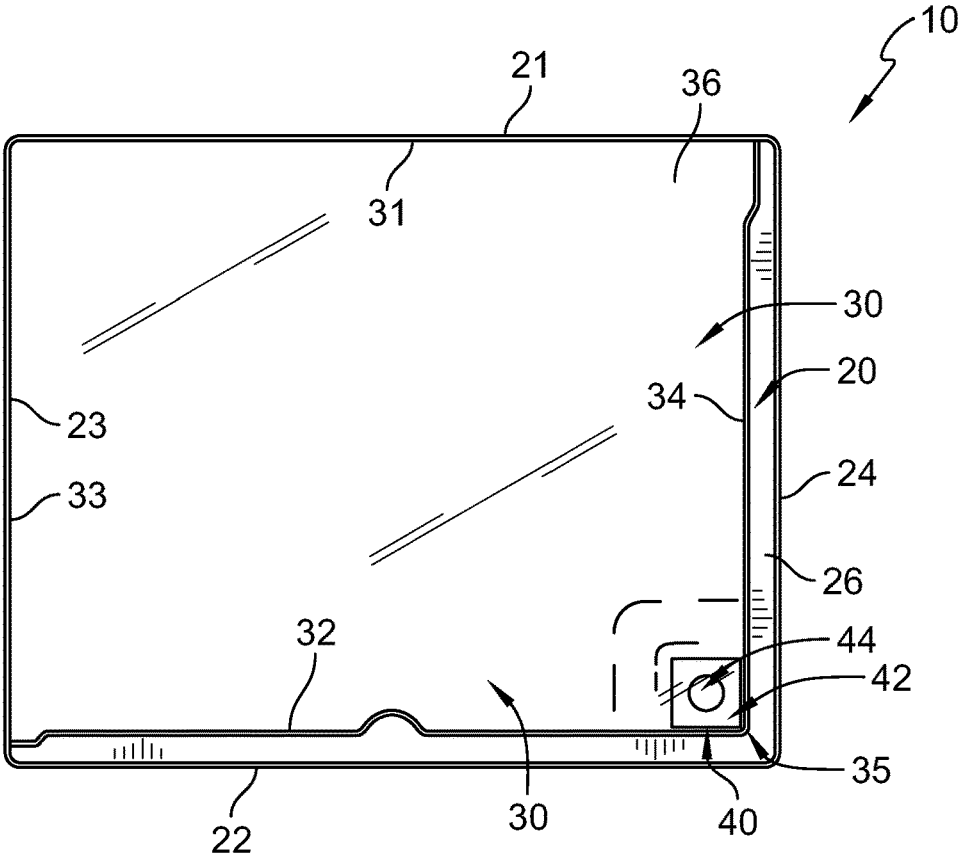
FIG. 3 is a front elevation view of the folder showing in FIGS. 1 and 2 showing that the folder includes a back flap, a front flap, and a magnetic closure arranged at the free corner of the front flap and configured to provide means for holding the front flap closed and for retaining papers in the paper storage space when the front flap is closed.

Each folder 10 includes a back flap 20, a front flap 30, and a magnetic closure 40 as shown in FIGS. 1-3. The back flap 20 supports the front flap 30 and is optionally configured to be mounted to the status board 15. The front flap 30 is coupled to the back flap 20 along two sides and has a free corner 35 that may be lifted to open the front flap and to disengage the magnetic closure 40 as shown in FIG. 2. The magnetic closure 40 is located adjacent to the free corner 35 and holds the free corner 35 of the front flap 30 in place relative to the back flap 20 when the front flap 30 is closed.

The back flap 20 is illustratively rectangular and constructed of opaque, flexible, vinyl materials as suggested in FIGS. 1-4. The back flap 20 has a top side 21, a bottom side 22, a left side edge 23, and a right side edge 24. The back flap 20 also has a front side 26 and a back side 28. In some embodiments, the back flap 20 may have other suitable shapes and may be made from other suitable materials. In addition, the back flap 20 may have any color and may be transparent.

The front flap 30 is illustratively constructed of transparent, flexible, vinyl materials as suggested in FIGS. 1-3. The front flap 30 has a top side 31, a bottom side 32, a left side edge 33, and a right side edge 34. The front flap 30 also has a front side 36 and a back side 38. In some embodiments, the front flap 30 may be made from other suitable materials. In addition, the front flap 30 may have any color and may be opaque.

In the illustrative embodiment, shown in FIG. 3, the top edge 31 of the front flap 30 is aligned with the top edge 21 of the back flap 20. The bottom edge 32 of the front flap 30 spaced apart from the bottom edge 22 of the back flap 20. The left side edge 33 of the front flap 30 is aligned with the left edge 23 of the back flap 20. The right side edge 34 of the front flap 30 is spaced apart from the right edge 24 of the back flap 20.

The front flap 30 is illustratively coupled to the back flap 20 along the top edge 21 of the back flap 20 and along the left side edge 23 of the back flap 20 by plastic weld lines as shown in FIG. 3. Sealing along the top edges 21, 31 keeps dirt and debris from entering the folder 10 when used as part of system 100. However, the folders 10 may be use in any orientation.

Figure 5:
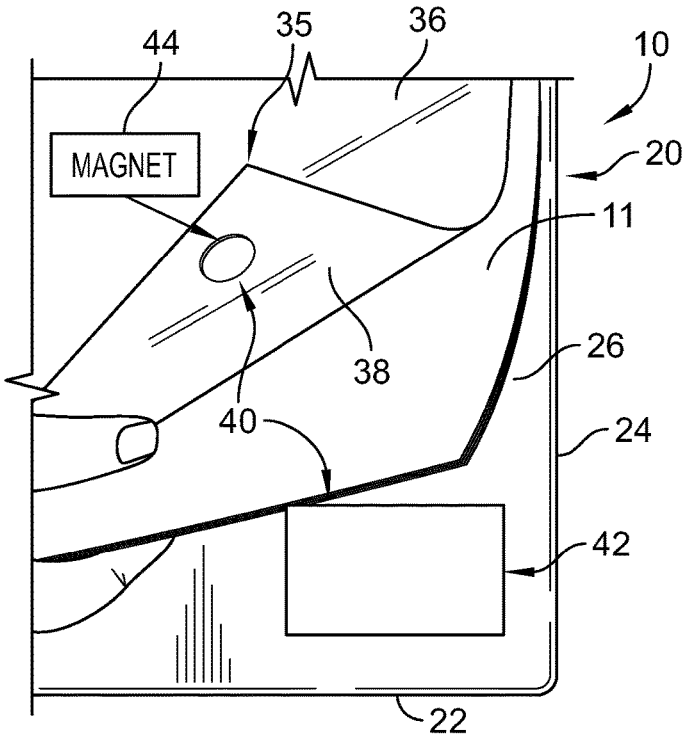
FIG. 5 is a detail view of the folder of FIGS. 1-4 showing the front flap lifted to an opened position with papers inserted into a paper storage space and showing that the magnetic closure includes a patch of magnetic-receptive material coupled to the back flap and a magnet coupled to the front flap.
Figure 6:
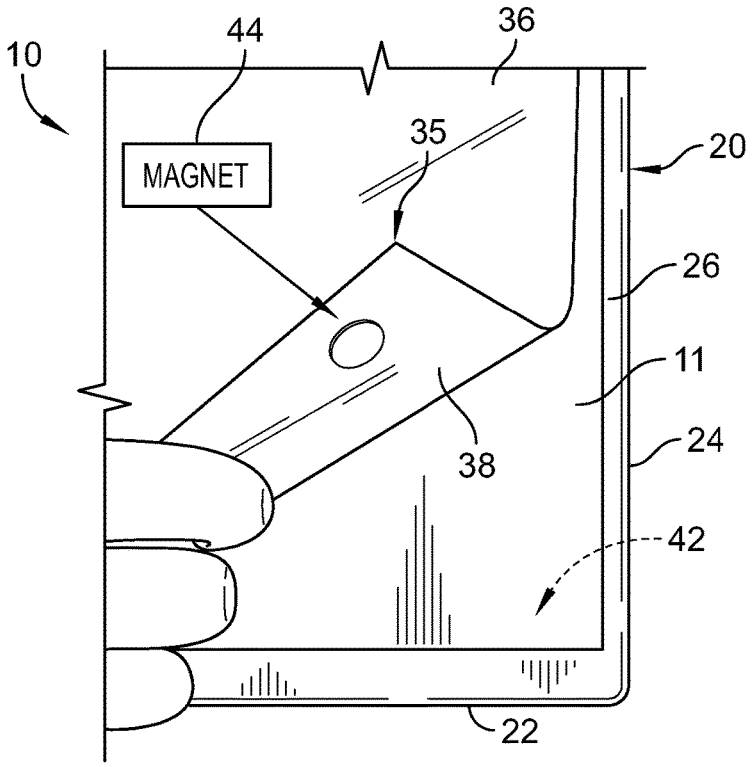
FIG. 6 is view similar to FIG. 5 showing the papers released to cover the patch of magnetic-receptive material before the free corner of the front flap is lowered to re-engage the magnetic closure.
Figure 7:
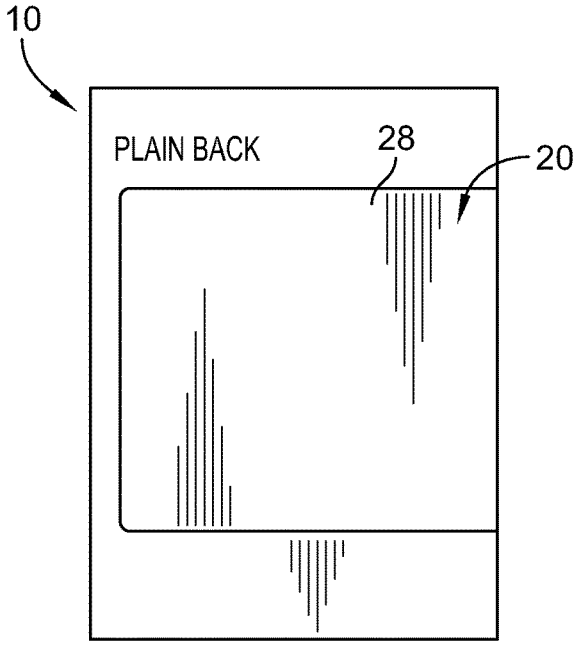
FIG. 7 is a detail view of a back side of a back flap included as part of a folder in accordance with the present disclosure showing that the mount strips may be omitted.

The front flap 30 remains free along the bottom edge 32 of the front flap 30 and the right side edge 34 of the front flap 30 so as to provide the free corner 35 of the front flap 30. The free corner 35 is suitable to be lifted away from the back flap 20 by a user to move the front flap 30 from a closed position to an opened position as suggested in FIGS. 2, 5, and 6.

The magnetic closure 40 is configured to hold papers 11 in place within the folder 11 when the front flap 30 is in the closed position as suggested in FIG. 1. The magnetic closure 40 includes a patch of magnetic-receptive material 42 coupled to the back flap 20 and a magnet 44 coupled to the front flap 30. The patch 42 and the magnet 44 are arranged between the back flap 20 and the front flap 30 adjacent to the free corner 35 of the front flap 30.

In the illustrative embodiment, patch of magnetic-receptive material 42 is made from flexible non-magnetized magnetic-receptive material. One illustrative magnetic receptive material suitable for use is sold under the trade name RUBBERSTEEL® from MAGNUM® brand. The patch of magnetic-receptive material 42 is coupled via adhesive to the front side 26 of the back flap 20 so that the patch 42 is between back flap 20 and front flap 30. In other embodiments, the patch 42 may be coupled to the back side 28 of the back flap 20. In other embodiments, the patch 42 may be made from any suitable non-magnetized, magnetic-receptive material such as steel or other ferrous materials.

The patch 42 is illustratively sized to be larger than the magnet 44 so as to allow for various alignments of the patch 42 and the magnet 44 as shown in FIG. 3. This allowance for misalignment can allow for different thicknesses of paper and imperfect tolerances of the flaps 20, 30. Such allowance may not be available when two magnetized elements provide a closure and are drawn to a repeatable engaged position. The patch 42 is illustratively rectangular but may have any suitable shape, preferably (but not necessarily), larger than the magnet 44 when the folder 10 is viewed from the front.

The magnet 44 is illustratively a strong permanent magnet as shown in FIGS. 1-3. The magnet 44 is coupled to the back side 38 of the front flap 30 by an adhesive so that the magnet 44 is between the flaps 20, 30 when the front flap 30 is closed as suggested in FIGS. 1-6. In other embodiments, the magnet 44 may be coupled to the front side 36 of the front flap 30.

In some embodiments, the patch 42 and the magnet 44 may switch location. For example, the patch 42 may be coupled to the front flap 30 and the magnet 44 may be coupled to the back flap 20.

Figure 4:
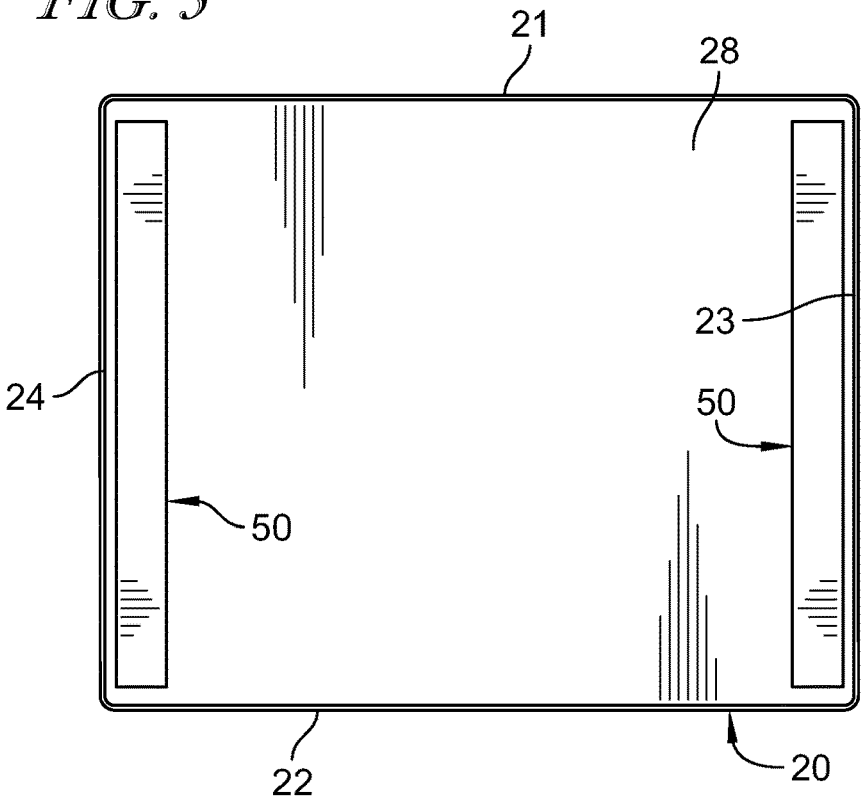
FIG. 4 is a rear elevation view of the folder of FIGS. 1-3 showing mount strips coupled to a back side of the back flap for suspending the folder in a vertical orientation.
Figure 8:
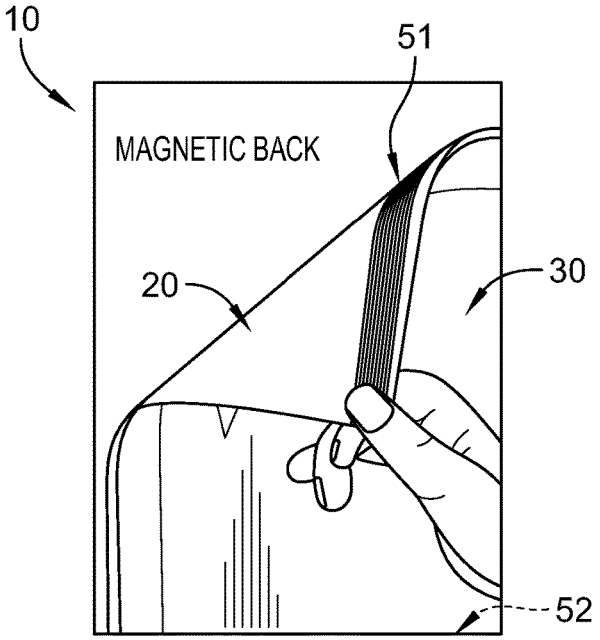
FIG. 8 is a detail view of a back side of a back flap included as part of a folder in accordance with the present disclosure showing that the mount strips may be magnetic strips for suspending the folder on a magnetic-receptive board.

In some embodiments, the folder may include mount strips 50 coupled to the back side 38 of the back flap 20 as shown in FIG. 4. The mount strips 50 are configured so that the folder 10 can be vertically suspended on a status board 15 as suggested in FIG. 1. The mount strips 50 may include magnetic strips 51, 52, adhesive strips 61, 62, or hook and loop material strips 71, 72 as shown in FIGS. 8-10. The mount strips 50 illustratively extend along and parallel to the left side edge 23 of the back flap 20 and the right side edge 24 of the back flap 20. In other embodiments, other arrangements of the strips may be used.

The folders 10 and system 100 may be used in a variety of methods. According to one specific method, a user may update a visual management system 100 including a folder 10 as shown and described. Such a method may include lifting the free corner 35 of the front flap 30 of the folder 10 to disengage the magnetic closure 40. The method may include inserting papers 11 into the folder 10 between the back flap 20 and the front flap 30 and/or marking on paper 11 to update information. The method may further include lowering the free corner 35 of the front flap 30 to re-engage the magnetic closure 40 and hold the paper 11 in place while also holding the front flap 30 closed.

The size of the folders 10 disclosed is illustratively designed for use with letter size sheets of paper 11 (8.5 inches by 11 inches). In a preferred embodiment, the drawings of the application are true to scale for such uses. However, in other embodiments, the folders 10 may be resized for use with other sizes of paper.

The invention claimed is:

1. A folder for storing papers, the folder comprising a back flap the back flap having a top edge, a bottom edge, a left side edge, and a right side edge, a front flap comprising flexible polymeric materials, the front flap having a top edge aligned with the top edge of the back flap, a bottom edge spaced apart from the bottom edge of the back flap, a left side edge aligned with the left edge of the back flap, and a right side edge spaced apart from the right edge of the back flap, wherein the front flap is coupled to the back flap along the top edge of the back flap and along the left side edge of the back flap while remaining free along the bottom edge of the front flap and the right side edge of the front flap so as to provide a free corner of the front flap suitable to be lifted away from the back flap by a user to move the front flap from a closed position to an opened position, and a magnetic closure including a patch of flexible non-magnetized magnetic-receptive material coupled via adhesive to the back flap and a magnet coupled to the front flap, the patch located adjacent to the free corner of the front flap within a footprint of the front flap when viewed from a front side of the folder, the magnet located adjacent to the free corner of the front flap within the footprint of the front flap when viewed from the front side of the folder, and the magnet arranged to move with the front flap from outside a footprint of the patch when viewed from the front side of the folder to within the footprint of the patch when viewed from the front side of the folder upon movement of the front flap to the closed position so that the front flap is held in the closed position and any papers arranged between the patch and the magnet are held in place within the folder when the front flap is in the closed position.

2. The folder of claim 1, wherein the patch of flexible non-magnetized magnetic-receptive material and the magnet are arranged between the back flap and the front flap when the front flap is in the closed position.

3. The folder of claim 1, further comprising mount strips coupled to a back side of the back flap, the mount strips including at least one of magnetic strips, adhesive strips, and hook and loop material strips.

4. The folder of claim 3, wherein the mount strips extend along and parallel to the left side edge of the back flap and the right side edge of the back flap.

5. The folder of claim 1, wherein the front flap comprises at least semi-transparent materials.

6. The folder of claim 5, wherein the front flap comprises transparent vinyl materials.

7. The folder of claim 1, wherein the back flap comprises flexible vinyl materials.

8. The folder of claim 7, wherein the back flap is opaque.

9. A visual management system, the system comprising a status board mounted above a floor, a folder including a back flap the back flap having a top edge, a bottom edge, a left side edge, and a right side edge, a front flap, the front flap having a top edge aligned with the top edge of the back flap, a bottom edge spaced apart from the bottom edge of the back flap, a left side edge aligned with the left edge of the back flap, and a right side edge spaced apart from the right edge of the back flap, wherein the front flap is coupled to the back flap along the top edge of the back flap and along the left side edge of the back flap while remaining free along the bottom edge of the front flap and the right side edge of the front flap, and a magnetic closure including a patch of flexible non-magnetized magnetic-receptive material coupled via adhesive to the back flap and a magnet coupled to the front flap for movement therewith, the patch located adjacent to the free corner of the front flap within a footprint of the front flap when viewed from a front side of the folder, the magnet located adjacent to the free corner of the front flap within the footprint of the front flap when viewed from the front side of the folder, and a sheet of paper arranged between the back flap and the front flap with a portion of the sheet of paper located between the patch of flexible non-magnetized magnetic-receptive material and the magnet to fix the sheet of paper in place relative to the folder, wherein the folder is mounted to the status board with the bottom edge of the back flap and the bottom edge of the front flap facing the floor.

10. The folder of claim 9, wherein the patch of flexible non-magnetized magnetic-receptive material and the magnet are arranged between the back flap and the front flap when the front flap is in the closed position.

11. The folder of claim 9, further comprising mount strips coupled to a back side of the back flap, the mount strips including at least one of magnetic strips, adhesive strips, and hook and loop material strips.

12. The folder of claim 11, wherein the mount strips extend along and parallel to the left side edge of the back flap and the right side edge of the back flap.

13. The folder of claim 9, wherein the front flap comprises at least semi-transparent materials.

14. The folder of claim 13, wherein the front flap comprises transparent vinyl materials so that the sheet of paper is visible through the front flap.

15. The folder of claim 9, wherein the back flap comprises flexible vinyl materials.

16. vThe folder of claim 15, wherein the back flap is opaque.

17. A method of updating a visual management system, the method comprising providing a folder for storing papers, the folder including (i) a back flap the back flap having a top edge, a bottom edge, a left side edge, and a right side edge, (ii) a front flap comprising flexible polymeric materials, the front flap having a top edge aligned with the top edge of the back flap, a bottom edge spaced apart from the bottom edge of the back flap, a left side edge aligned with the left edge of the back flap, and a right side edge spaced apart from the right edge of the back flap, wherein the front flap is coupled to the back flap along the top edge of the back flap and along the left side edge of the back flap while remaining free along the bottom edge of the front flap and the right side edge of the front flap so as to provide a free corner of the front flap suitable to be lifted away from the back flap by a user to move the front flap from a closed position to an opened position, and (iii) a magnetic closure including a patch of flexible non-magnetized magnetic-receptive material coupled via adhesive to the back flap and a magnet coupled to the front flap, the patch located adjacent to the free corner of the front flap within a footprint of the front flap when viewed from a front side of the folder, the magnet located adjacent to the free corner of the front flap within the footprint of the front flap when viewed from the front side of the folder, and the magnet arranged to move with the front flap from outside a footprint of the patch when viewed from the front side of the folder to within the footprint of the patch when viewed from the front side of the folder upon movement of the front flap to the closed position so that the front flap is held in the closed position and any papers arranged between the patch and the magnet are held in place within the folder when the front flap is in the closed position;

lifting the free corner of the front flap of the folder to move the front flap to the opened position such that the magnetic closure is disengaged, inserting a sheet of paper into the folder between the back flap and the front flap, and lowering the free corner of the front flap of the folder to move the front flap to the closed position such that the magnetic closure is engaged so that the front flap is held in the closed position and the sheet of paper arranged between the patch and the magnet are held in place within the folder when the front flap is in the closed position.

18. The method of claim 17, wherein the method includes marking on the sheet of paper to update information on the sheet of paper.

19. The method of claim 17, wherein the front flap comprises transparent vinyl materials so that the sheet of paper is visible through the front flap.

20. The method of claim 17, wherein the folder is mounted to a status board with the bottom edge of the back flap and the bottom edge of the front flap facing the floor.

* * * * *